US006267064B1

(12) United States Patent
Ostertag et al.

(10) Patent No.: US 6,267,064 B1
(45) Date of Patent: Jul. 31, 2001

(54) LABORATORY FURNITURE UNIT

(75) Inventors: Hubert L. Ostertag, Holland, MI (US); Jay D. Bargmann, Pelham, NY (US); David R. Appel, Ada, MI (US); George J. Simons, Jr., Grand Rapids, MI (US); Mark A. Buchalter; Yasuyuki Hirai, both of East Grand Rapids, MI (US); Howard M. Montgomery, Grand Rapids, MI (US)

(73) Assignee: Steelcase Development Corporation, Grand Rapids, MI (US)

( * ) Notice: Subject to any disclaimer, the term of this patent is extended or adjusted under 35 U.S.C. 154(b) by 0 days.

(21) Appl. No.: 09/431,637

(22) Filed: Nov. 1, 1999

(51) Int. Cl.[7] ..... A47B 37/00

(52) U.S. Cl. ..... 108/50.02; 108/23; 108/108; 312/209; 211/187

(58) Field of Search ..... 312/223.3, 223.5, 312/223.6, 209; 52/36.2, 36.4, 220.1, 220.7; 248/241, 247, 250; 211/187, 207, 208; 108/23, 50.02, 108, 107, 106, 187, 190, 147.11, 147.17, 149, 152, 157.13, 158.11

(56) References Cited

U.S. PATENT DOCUMENTS

| | | |
|---|---|---|
| D. 252,820 | 9/1979 | Olson . |
| D. 279,740 | 7/1985 | Slager . |
| D. 284,532 | 7/1986 | Vogt . |
| D. 306,101 | 2/1990 | Borsani . |
| D. 318,966 | 8/1991 | Schroff et al. . |
| D. 339,936 | 10/1993 | Gunten et al. . |
| D. 340,157 | 10/1993 | Von Gunten et al. . |
| D. 359,182 | 6/1995 | Von Gunten et al. . |

FOREIGN PATENT DOCUMENTS

620990 * 10/1994 (EP) ..... 108/50.02

OTHER PUBLICATIONS

Exhibit J discloses a prior art product brochure entitled *A world of possibilites. Introducing Contrada. The next generation in office furniture*, published by Trendway, 1998.

* cited by examiner (List continued on next page.)

*Primary Examiner*—Janet M. Wilkens
(74) *Attorney, Agent, or Firm*—Price Heneveld Cooper Dewitt & Litton

(57) ABSTRACT

A furniture unit is provided specially adapted for use in laboratories. The furniture unit includes a pair of spaced-apart uprights and vibration-dampening legs extending from the uprights for stably supporting the furniture unit on a floor surface. A belt-high structural beam comprising two opposing C-shaped beams is fixedly attached to the uprights to rigidly interconnect the uprights in a spaced relationship. A plurality of worksurfaces is provided, each having a pair of cantilever brackets configured to rigidly connect to a side of the belt-high structural beam and to extend laterally therefrom. The plurality of worksurfaces is separately adjustably supported on the belt-high structural beam for vertical height adjustment, with at least one of the cantilever brackets engaging the belt-high structural beam at a location between the uprights. Shelves are attached between the uprights above the plurality of worksurfaces. Optionally, an accessory panel is mounted between the front and rear shelves for visual shielding and/or for function use, such as a marker board. A Y-shaped lighting support includes a bayonet that telescopingly engages a top of the uprights. A lamp housing structure spans between the lighting supports in a location where a lamp in each lamp housing structure is generally above a front edge of the worksurfaces. A utility distribution beam is mounted between the uprights above the structural beam for communicating utilities, including piped utilities and cabled utilities, to accessible locations along a rear edge of the worksurfaces. The legs include gussets that telescope into the uprights to provide a stable bottom joint.

27 Claims, 13 Drawing Sheets

U.S. PATENT DOCUMENTS

| | | | | |
|---|---|---|---|---|
| D. 363,701 | | 10/1995 | Paquette et al. . | |
| D. 379,887 | | 6/1997 | Muller-Deisig et al. . | |
| D. 392,476 | | 3/1998 | Mitchell . | |
| D. 398,166 | | 9/1998 | Mitchell . | |
| D. 399,683 | | 10/1998 | Nicklas . | |
| D. 405,980 | | 2/1999 | Mitchell . | |
| 2,943,897 | | 7/1960 | Johnson et al. . | |
| 2,972,495 | * | 2/1961 | Yalen . | |
| 2,983,389 | * | 5/1961 | Trautmann | 108/102 X |
| 3,101,681 | | 8/1963 | Streater . | |
| 3,212,648 | | 10/1965 | Baker, Jr. et al. . | |
| 3,229,824 | | 1/1966 | De'Caccia . | |
| 3,303,936 | | 2/1967 | Barnawell . | |
| 3,512,654 | | 5/1970 | Olsen et al. . | |
| 3,664,063 | | 5/1972 | Ware . | |
| 3,920,299 | * | 11/1975 | Propst et al. | 312/209 |
| 4,032,821 | | 6/1977 | Keiser . | |
| 4,045,911 | | 9/1977 | Ware . | |
| 4,272,136 | * | 6/1981 | Sengua | 312/223.1 X |
| 4,312,086 | | 1/1982 | Bianco . | |
| 4,422,385 | * | 12/1983 | Rutsche et al. | 108/23 X |
| 4,469,029 | | 9/1984 | Ramond . | |
| 4,544,214 | * | 10/1985 | Nizel et al. | 312/209 |
| 4,612,863 | | 9/1986 | Vonhausen et al. . | |
| 4,646,211 | | 2/1987 | Gallant et al. . | |
| 4,771,583 | | 9/1988 | Ball et al. . | |
| 4,831,791 | | 5/1989 | Ball . | |
| 4,863,223 | | 9/1989 | Weissenbach et al. . | |
| 4,914,873 | | 4/1990 | Newhouse . | |
| 4,919,282 | | 4/1990 | Duff et al. . | |
| 4,920,458 | | 4/1990 | Jones . | |
| 5,152,698 | | 10/1992 | Juhlin et al. . | |
| 5,209,035 | | 5/1993 | Hodges et al. . | |
| 5,272,991 | * | 12/1993 | Carrigan, Jr. | 108/108 |
| 5,282,341 | | 2/1994 | Baloga et al. . | |
| 5,362,923 | | 11/1994 | Newhouse et al. . | |
| 5,394,658 | | 3/1995 | Schreiner et al. . | |
| 5,433,327 | | 7/1995 | Benvenuti et al. . | |
| 5,511,348 | | 4/1996 | Cornell et al. . | |
| 5,606,919 | | 3/1997 | Fox et al. . | |
| 5,638,644 | | 6/1997 | Bastian . | |
| 5,724,778 | | 3/1998 | Cornell et al. . | |
| 5,791,260 | | 8/1998 | Mack et al. . | |
| 5,794,794 | | 8/1998 | Hull . | |
| 5,831,211 | | 11/1998 | Gartung et al. . | |
| 5,833,332 | | 11/1998 | Marshall et al. . | |
| 5,881,500 | * | 3/1999 | Latino et al. | 52/220.7 X |
| B1 4,224,769 | | 5/1990 | Ball et al. . | |

LABORATORY FURNITURE UNIT

BACKGROUND OF THE INVENTION

The present invention concerns furniture units particularly adapted for use in a laboratory environment to facilitate the work of laboratory technicians.

Traditionally laboratory furniture is often made to be heavy duty and relatively massive due to functional requirements of same, with laboratory benches having thick chemical-resistant tops and top-supporting cabinetry adapted for glassware and chemical storage. Usually the cabinetry is permanently secured to a floor. However, massive furniture intended for permanent installation is unnecessarily expensive to manufacture, ship and install, as well as expensive and difficult to rearrange. Thus, traditional laboratory furniture typically cannot be easily rearranged for specialized work groups nor for special short-term projects. Nor can it be easily reconfigured to optimize its layout as laboratory needs and research team needs evolve and change over time.

Another problem is that the furniture in many laboratories prevents organizing them for efficient operation. Specifically, many laboratories are divided into large first work areas adapted for laboratory testing, and isolated second work areas for doing paperwork and computer work. In theory, such arrangements of laboratory furniture are good because they place resources for specialized laboratory tasks at the laboratory work area and also prevent chemicals from being spilled onto paperwork and onto computers. However, this type of arrangement forces workers to constantly move between laboratory work areas for conducting tests, and "office" areas for documenting and reporting results and for working on computers (such as for conducting computer-assisted research, computer-assisted analysis of test results, as well as word processing). Tasks in modern laboratories are much more integrated and interactive then they used to be, and modern laboratories must accommodate this change to gain efficiencies in worker output. Though change is needed, the change must be done in a manner that accommodates the needs and preferences of laboratory technicians.

Many modern office furniture systems are rearrangeable, but they will not satisfactorily meet the durability and special needs of laboratory furniture listed above, since modern office furniture is typically not as heavy duty and massive as laboratory furniture. Further, modern office equipment is not equipped to handle distribution of natural gas or the like. It is desirable to supply furniture units that are stronger and more massive then existing office furniture so that laboratory test equipment is securely and stably supported and so that traditional laboratory technicians are satisfied, while still retaining the ability to be rearranged to optimize doing work and to optimize team activities. Another need is for the worksurfaces to be isolated from vibrations so that they do not communicate vibration to highly sensitive electronic laboratory test equipment rested on the worksurfaces. It is also desired to provide laboratory furniture that will allow customization for individual tasks and for personal preferences along a workbench. Concurrently, laboratory furniture is desired that is capable of being adjusted to meet the needs of wheelchair-bound technicians. Still further, a laboratory furniture unit is desired that is able to accommodate and logistically integrate different laboratory activities, such as laboratory experimentation activities along with word processing and computer-related activities. Also, a modernistic design is desired that is highly functional, yet less traditional in appearance.

Accordingly, a furniture unit offering the above advantages and solving the aforementioned disadvantages is desired. More specifically, laboratory furniture is needed that retains the durability and structural characteristics of traditional laboratory furniture, but that is lower cost, easier to ship and install, and that is rearrangeable, reconfigurable, and adjustable to meet changing needs of laboratories. At the same time, the laboratory furniture must minimize manufacturing, shipping, and installation costs.

SUMMARY OF THE PRESENT INVENTION

In one aspect of the present invention, a furniture unit adapted for use in a laboratory includes a frame having a pair of spaced-apart uprights, a belt-high structural beam rigidly interconnecting the uprights, and legs extending from the uprights for stably supporting the frame on a floor surface. The structural beam has sides and is sufficient in structure and size to support worksurfaces and laboratory equipment in cantilever off the sides at locations spaced from the uprights. A plurality of worksurfaces is separately adjustably supported in cantilever on the belt-high beam for vertical height adjustment.

In another aspect of the present invention, a kit for constructing a furniture unit includes a pair of spaced-apart uprights having legs extending from the uprights for stably supporting the furniture unit on a floor surface. A belt-high structural beam includes upright-engaging brackets constructed to rigidly interconnect the upright in a spaced relationship. A plurality of individual-sized worksurfaces are provided that each have cantilever brackets configured to rigidly adjustably engage a side of the belt-high structural beam and to extend laterally therefrom. The plurality of worksurfaces is configured to be separately adjustable supported on the belt-high beam in laterally adjacent positions for vertical height adjustment. At least one of the cantilever brackets engages the belt-high structural beam at a location between the uprights. At least one shelf is provided that is configured for attachment between the uprights at a location spaced above the plurality of worksurfaces. A lighting support is provided that is configured to engage a top of the uprights. A lamp housing structure is configured to engage and be supported on each of the lighting supports in a location where the lamp housing structure is located generally above a front edge of one of the plurality of worksurfaces. The kit is preferably constructed for compact shipment and on-site assembly.

In another aspect of the present invention, a furniture unit includes a frame having a pair of spaced-apart uprights, and a belt-high structural beam rigidly interconnecting the uprights. The structural beam includes opposing C-shaped beams that are at least about 12 gauge commercially available beams. The C-shaped beams engage opposing side faces of the uprights to form a box-shaped structure having sides. The beams are sufficient in structure and size to support worksurfaces and laboratory equipment in cantilever of the side faces at locations spaced from the uprights. First and second worksurfaces are separately supported in cantilever on the belt-high beam for vertical height adjustment. The first and second worksurfaces each include cantilever brackets that engage and are attached to one of the side faces.

In another aspect of the present invention, a furniture unit includes a frame having a pair of spaced-apart tubular uprights having open upper ends, and worksurfaces supported on the frame that define work areas below the upper ends, the worksurfaces extending laterally. First and second light supports each have a down tube shaped to mateably telescopingly engage the open ends, and further have laterally extending opposing arms that extend over the worksurfaces. A pair of lamp housings is supported by ends of the opposing arms and extends between the first and second light supports. The lamp housings include light sources that are positioned to illuminate the work areas.

In yet another aspect of the present invention, a furniture unit includes a frame including a pair of spaced-apart tubular uprights having open bottom ends, and worksurfaces supported on the frame that define work areas above the bottom ends, with the worksurfaces extending laterally. A tubular leg is connected to each of the bottom ends of the uprights at leg-to-upright connections. Each leg-to-upright connection includes a pair of upwardly extending space-apart gussets welded to the leg. The gussets are dimensioned to fit telescopingly into the associated bottom end and to closely engage opposing inside surfaces of the bottom end to achieve a stable perpendicular joint.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 1:
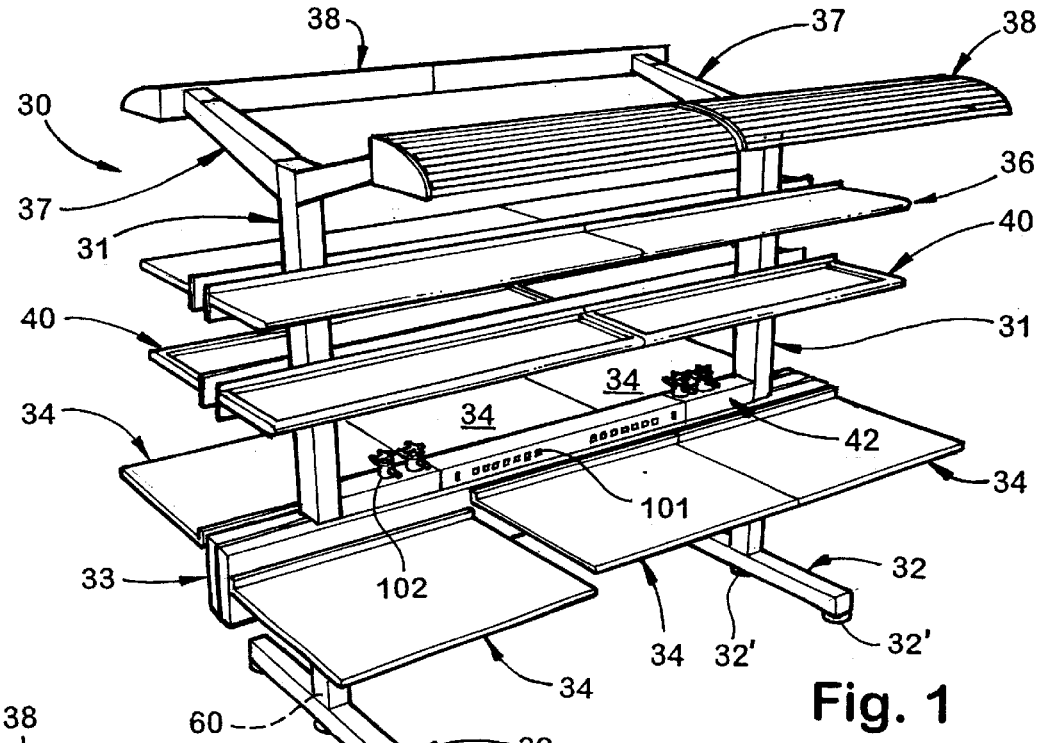
FIG. 1 is a perspective view of a furniture unit embodying the present invention adapted for use in a laboratory.

A furniture unit 30 embodying the present invention is provided as illustrated in FIG. 1. The furniture unit 30 is particularly adapted for use in a laboratory environment, although it is contemplated that the furniture unit 30 can be used in many non-laboratory applications where strong adjustable worksurfaces are required. The furniture unit 30 includes a pair of spaced-apart tubular uprights 31 with legs 32 extending laterally from bottoms of the uprights 31. The legs 32 include gussets 60 that strengthen their connection to the uprights 31, and further include vibration-dampening feet or levelers 32' that prevent building vibrations from being transmitted through the uprights to other parts of the furniture unit 30. For example, vibration dampeners will work having a vertically adjustable threaded stud and a vibration-absorbing neoprene or urethane pad, such as are made by Value Engineering, Inc., Irvin, Calif.

Figure 9:
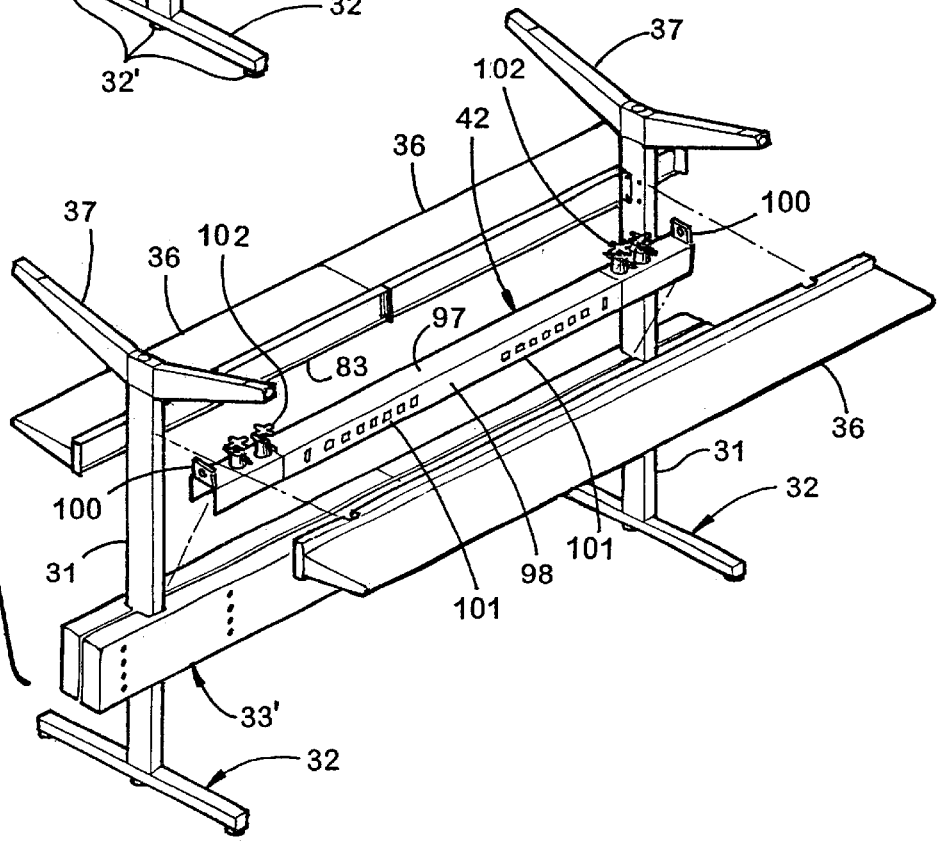
FIG. 9 is an exploded perspective view including the assembled frame of FIG. 6, and including the upper utility access channel beam, the shelf supports, and the shelves of FIG. 1.
Figures 9A, 9B:
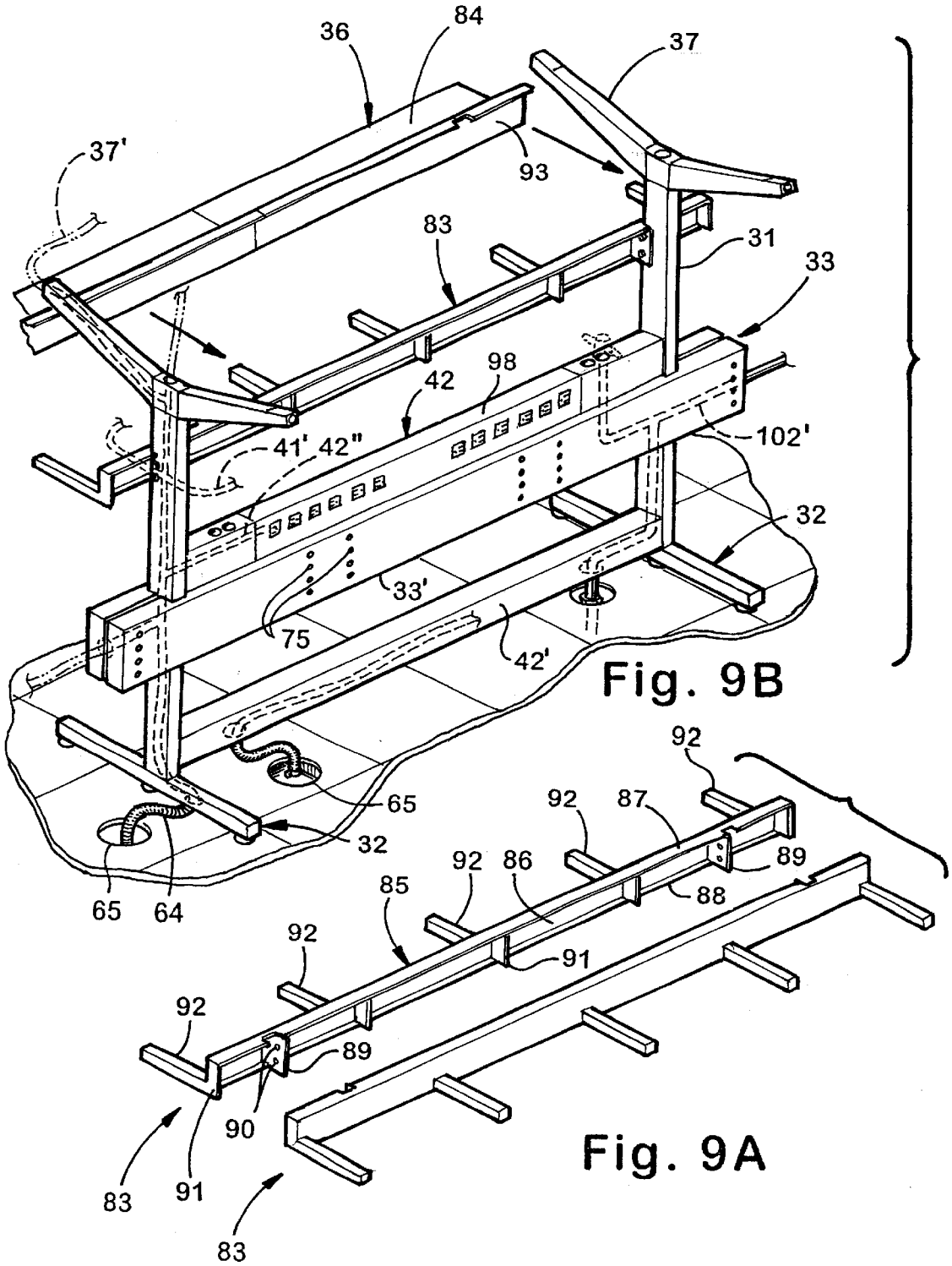
FIG. 9A is a perspective view of the shelf support shown in FIG. 9.
FIG. 9B is a perspective view of the shelf support shown in FIG. 9A installed on the assembled frame of FIG. 8, and further shows wiring and cabling routed throughout the laboratory furniture.
Figure 15:
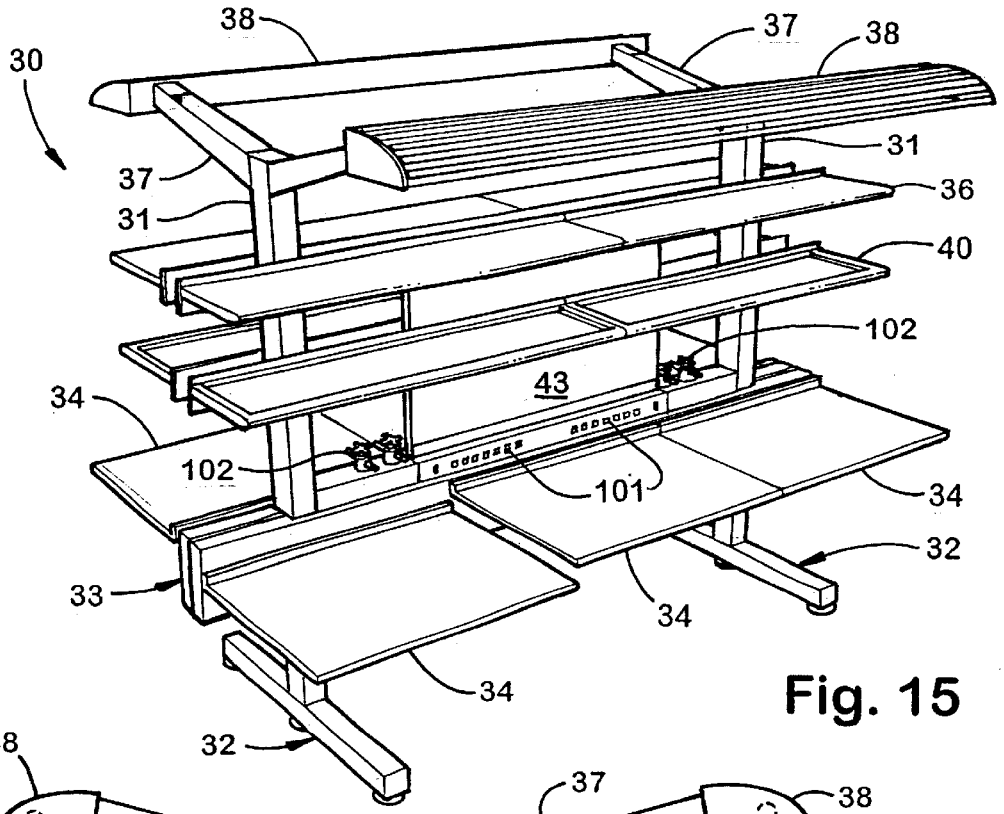
FIGS. 15 and 16 are perspective and end views similar to FIGS. 1 and 2, respectively, but including a vertical center panel.
Figure 16:
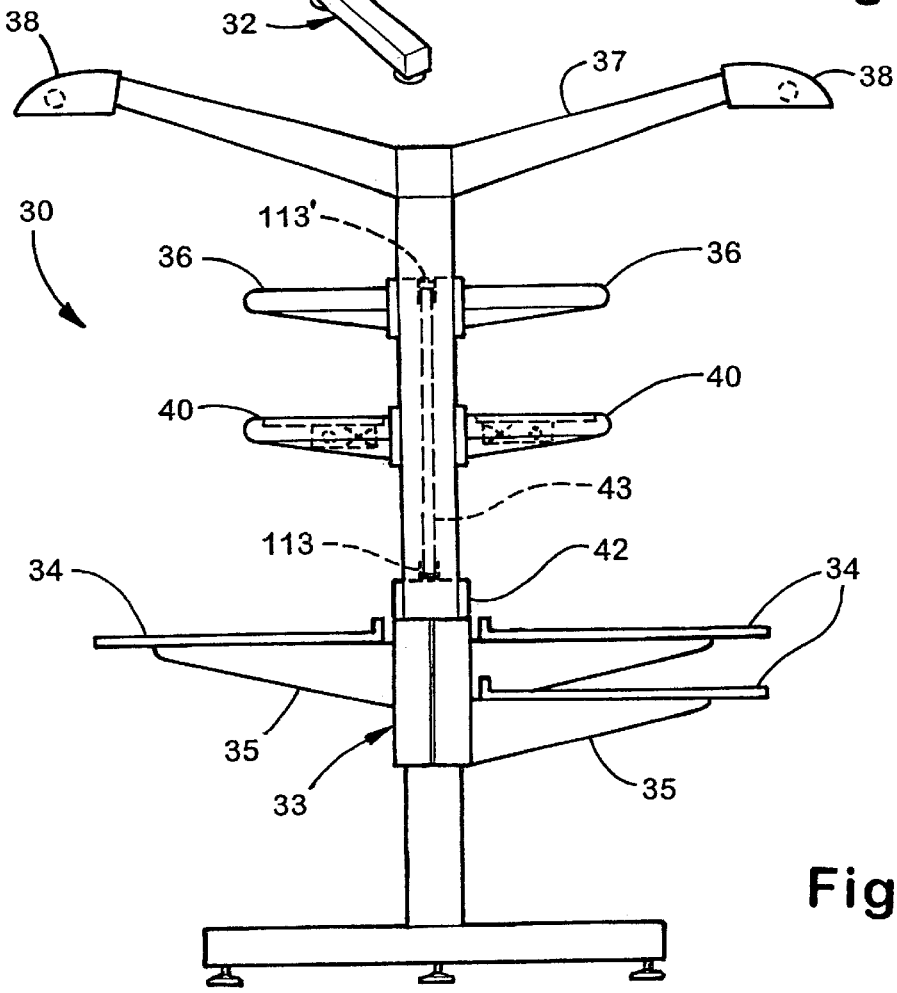

A belt-high structural beam 33 rigidly interconnects the uprights 31 in a spaced relationship, and a plurality of laterally adjacent worksurfaces 34 (three shown on each side) are attached to sides of the belt-high structural beam 33 by cantilever brackets 35. As described below, the worksurfaces 34 are separately adjustably supported on the belt-high structural beam 33 for individual adjustment. Notably, the structural beam 33 is sufficiently strong to support worksurfaces 34 in cantilever along its center section, even though both of the worksurface-supporting brackets 35 for the center worksurface 34 are attached at locations spaced substantially inwardly from the uprights 31. At least one top shelf 36 is fixedly attached between the uprights 31 at a location above the worksurfaces 34. The top shelf 36 is sufficiently rigid to help rigidify the whole furniture unit 30. Y-shaped lighting supports 37 include a tubular bayonet that telescopingly extends into a top of the uprights 31. Lamp housing structures 38 extend between the outer ends of the lighting supports 37 and position lamps 39 along a front edge of the worksurfaces 34. The illustrated furniture unit 30 further includes a second shelf 40 that supports a task light 41. A utility distribution beam 42 is mounted between the uprights 31 immediately above the structural beam 33 at a convenient location along a rear edge of the worksurfaces 34. Optionally, a divider panel or visual screen 43 (FIGS. 15 and 16) is mounted vertically between the front and rear shelves 36 and/or a bottom utility distribution beam 42' (FIG. 9B) is mounted between the uprights 31.

Figure 6:
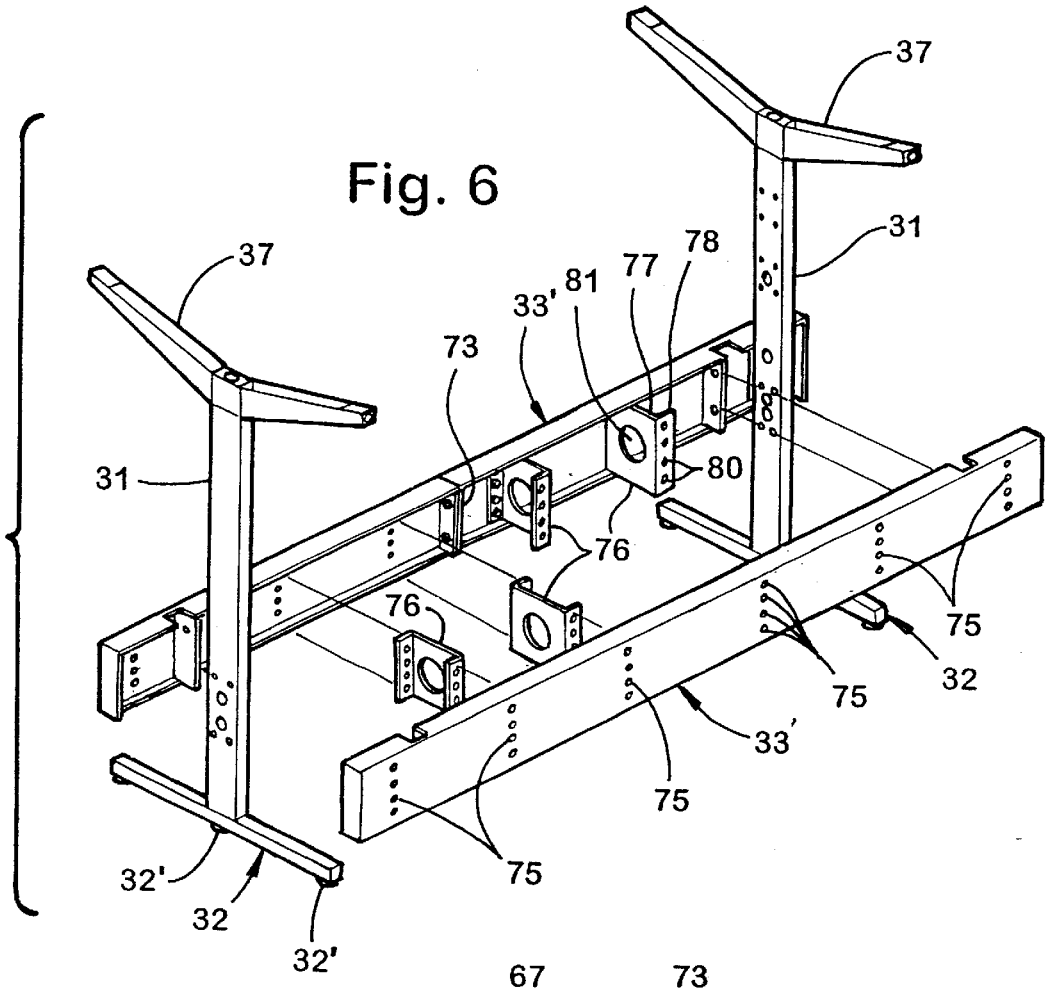
FIG. 6 is an exploded perspective view of the frame of the furniture unit shown in FIG. 1, including the uprights, the main structural beam, the lower utility channel, and the lighting supports.
Figure 7:
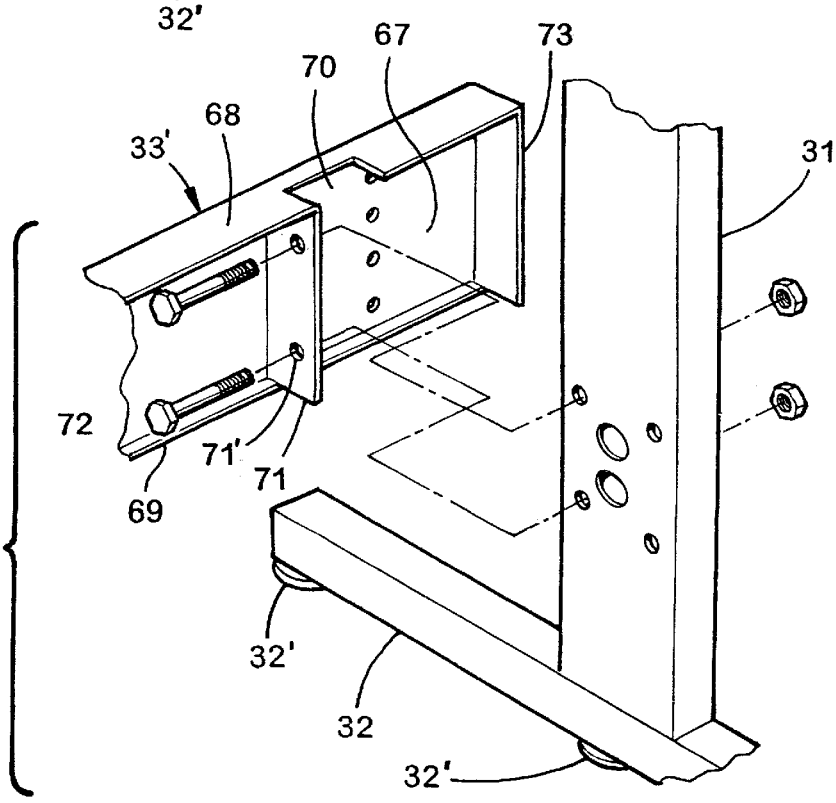
FIG. 7 is an enlarged fragmentary perspective view of the two C channels forming the main beam and their attachment to the uprights of FIG. 6.
Figure 6A:
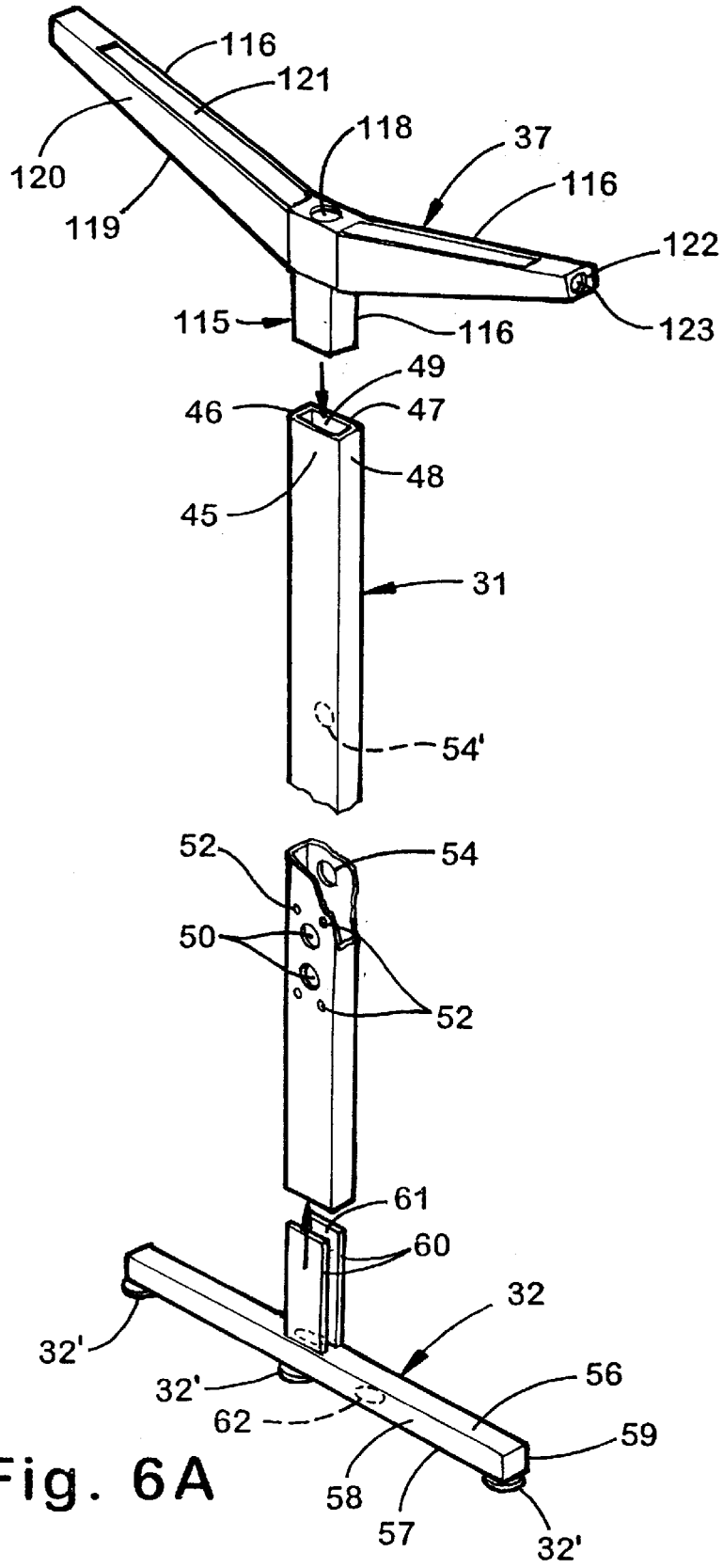
FIG. 6A is an exploded perspective view of an assembly of the upright, the leg, and the lighting support shown in FIG. 6.
Figure 8:
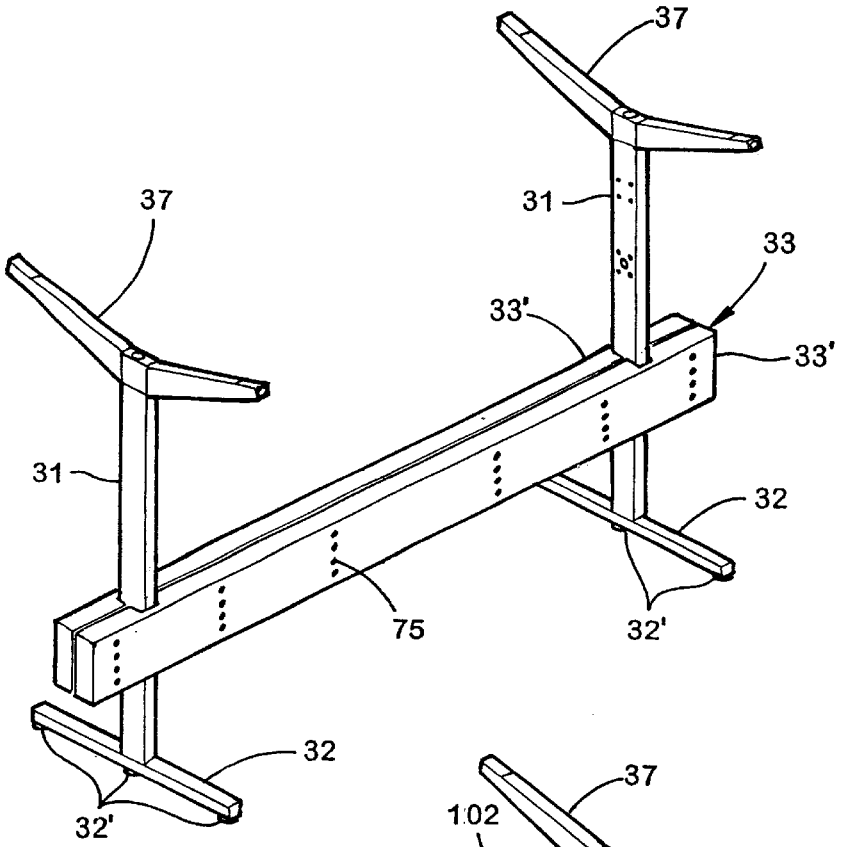
FIG. 8 is a perspective view of the assembled frame of FIG. 6.

Uprights 31 (FIG. 6A) is a tubular member with sidewalls 45–48 defining a rectangular cross section of about 4 inches by 8 inches and an internal passageway 49. One or more enlarged holes 50 are formed in the outer and inner sidewalls 45 and 47, respectively, at a height equal to beam 33 for communicating utilities horizontally through the upright 31 into the internal space within beam 33. Two vertically spaced holes 52 are also provided in sidewalls 45 and 47 at beam height for receiving bolts 53 (FIG. 7) to secure the beam structure 33 to the uprights 31. An additional enlarged hole 54 (FIG. 6) is provided in inner sidewall 47 slightly above beam height for communicating wiring and telecommunication cables into the utility distribution beam 42, and yet another enlarged hole 54' is located in inner sidewall 47 for communicating wiring to undershelf task light 41.

The legs 32 include a horizontal square tube section of about a 4-inch by 4-inch section with top, bottom, and sidewalls 56–59. The top wall 56 includes a pair of gusset plates 60 welded in a center of the top wall 56. The gusset plates 60 are arranged and have a rectangular shape selected so that they fit closely inside of a bottom end of the upright 31 against the sidewalls 45 and 47, with their edges fitting closely against sidewalls 46 and 48. After telescoping the upright 31 onto the gusset plates 60, the upright 31 is welded on the top wall 56. This provides a rigidified leg-to-upright joint capable of supporting the laboratory furniture unit 30. Notably, the illustrated laboratory furniture can easily weigh about 1200 pounds, plus the weight of laboratory equipment supported on the worksurfaces 34, depending upon the strength and massiveness designed into the components of the laboratory furniture 30. Nonetheless, it is contemplated that a scope of the present invention includes less massive (or more massive) furniture units constructed to meet different functional needs.

A space 61 between the gusset plates 60 defines a wireway. A hole 62 is formed in bottom wall 57 and a second hole (not specifically shown) is formed in top wall 56 between the gusset plates 60. As shown along a bottom left of FIG. 9B, wiring and cables 64 can be routed from a floor source 65 into the lower hole 62, along the tube section of leg 32 and up through the top wall 56 (between gusset plates 60) into the upright 31. The wiring and cables 64 are then routed to one of the undershelf task light 41 by wires 41', the utility distribution beam 42 by wires 42", or into the lighting supports 37 by wires 37' for the lamps 39, as desired.

It is contemplated that the structural beam 33 can be one piece or multi-piece. The illustrated structural beam 33 (FIGS. 6 and 7) includes two oppositely facing C-shaped beams 33' that are commercially available, such as 12 gauge C channels. The illustrated beams 33' include a vertical wall 67 (FIG. 7) and top and bottom flanges 68 and 69. The top flange 68 includes notches 70 shaped to mateably engage a side of the uprights 31. The bottom flange 69 is half cutoff in a longitudinal direction to increase the vertical bottom access space to the structural beam 33. This also eliminates the need for notches in the bottom flange 69. Attachment gussets 71 are welded transversely along a length of the beams 33'. The attachment gussets 71 are positioned to mateably engage a side of the uprights 31, and include holes 71' for receiving bolts 72 to secure the beams 33' to a side of the uprights 31. End-mounted gussets 73 are welded to beams 33' to close off an end of the beams 33'. Additional intermediate gussets can be added to beams 33' to strengthen the beams if desired. It is contemplated that short beams 33' can be bolted together to form a longer beam if needed (see the rear beams 33' in FIG. 6), such as by bolting two end-mounted gussets 73 together. This same concept can be used to secure adjacent laboratory furniture units 30 together inline with each other.

Figure 10:
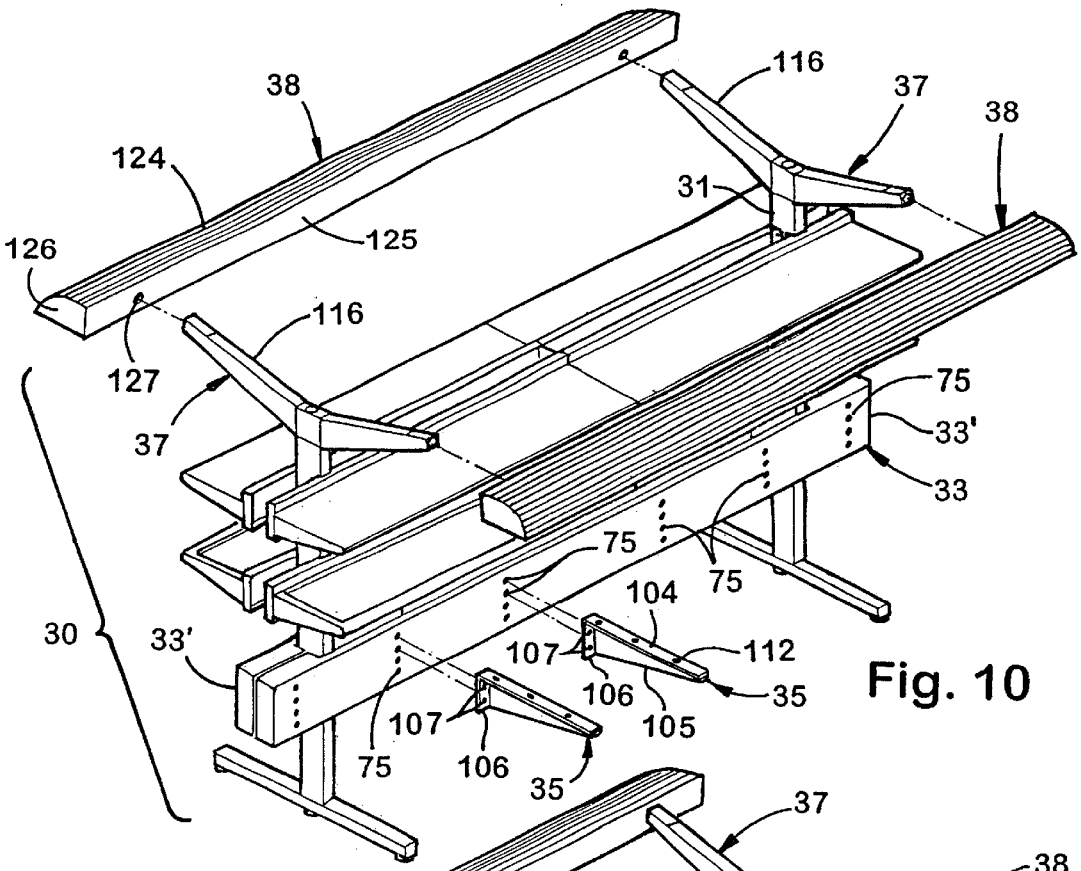
FIG. 10 is an exploded perspective view including the assembled frame and shelves of FIG. 9, and including the lamp-supporting structure and the cantilevered brackets for supporting the worksurfaces of FIG. 1.

The illustrated beams 33' (FIG. 10) include a plurality of bolt holes 75. The worksurface-supporting cantilever brackets 35 include holes 107 (described below) that are alignable with the holes 75 for receiving bolts to fasten the cantilever brackets 35 to sides of the beams 33'. The holes 75 are arranged to form vertical rows that are spaced to provide optimal support of the worksurfaces 34 by the cantilever brackets 35. The illustrated holes 75 define two vertical positions that can be selected for attachment of the cantilever brackets 35. The lower position is low enough to position the worksurface 34 for a wheelchair-bound person, and the higher position is high enough to position the worksurface 34 for a person sitting in a normal office chair. When in the lower position, the worksurface 34 is at a height that is ergonomically suited for supporting a typewriter or computer keyboard. It is contemplated that additional vertically adjusted positions for cantilever brackets 35 and the related worksurfaces 34 and be provided by adding more holes 75 to the beams 33'. Alternatively, the arrangement of holes 75 can be regularly spaced, such that four holes 75 can support the cantilever brackets 35 in three positions, for example.

Braces 76 (FIG. 6) can be added to reinforce and strengthen the beams 33' where added structure and stability is needed. The braces 76 are C-shaped and have a center web 77 and side flanges 78. The side flanges 78 include holes 80 that align with the holes 75, such that the bolts for mounting the cantilever brackets 35 are simply extended through the holes 80, as well as through the holes 75. The center web 77 includes an enlarged hole 81 for routing utilities horizontally through the braces 76. Preferably, the braces 76 are tack welded to one of the beams 33' and shipped as a unit, although the braces 76 could be added on-site if desired. The illustrated beams 33' do not include braces 76 near their ends, but of course braces 76 could be added there as well if desired.

The top shelf 36 (FIG. 9B) includes a shelf support 83 and a shelf panel 84 attached to the shelf support 83. The shelf support 83 (FIG. 9A) includes a horizontal C beam 85 that is not unlike the beams 33'. Specifically, the C beams 85 include a main web 86 and side flanges 87 and 88. The top side flange 87 is notched to mateably engage a side of the uprights 31. The bottom flange 88 is cut short to abut the side of the uprights 31. Attachment bracing 89 is added and includes bolt holes 90 for attachment to sides of the uprights 31. Additional bracing 91 is added to stiffen the C beam 85 as desired. Laterally extending tube sections 92 are welded to the main web 86 of C beam 85, with the end-most ones of the tube sections 92 having an outer wall flush with the end bracing 91 on the C beam 85. The shelf panel 84 (FIG. 9B) rests on the tube section 92 and includes an upwardly extending rear lip 93 that provides a splash guard and also provides a rear stop to prevent items stored on the shelf 36 from falling off the shelf panel 84 into the space between front and rear top shelves 36. It is noted that the shelf panel 84 can include a recess in its top surface (see the lower shelf 40, FIG. 1) to contain spilled liquid if desired. The illustrated top shelf 36 is not vertically adjustable, but it is contemplated that it could be if desired, such as by adding bolt holes to the inner sides of the uprights 31 where the shelf 36 attaches to the uprights 31.

The lower shelf 40 (FIG. 1) has a construction similar to the top shelf 36. Specifically the lower shelf 40 has a shelf support 94 and a shelf panel 95. The shelf panel 95 has a recess 96 therein to contain spilled liquids. The task light 41 is mounted under shelf 40 to the shelf support 94 at a location where it will illuminate tasks being performed on the worksurfaces 34. Electrical power is routed along wiring 41" (FIG. 9B) from the wiring within the uprights 31.

The belt-high utility distribution beam 42 (FIG. 9) comprises a downwardly facing C channel having top wall 97 and sidewalls 98. Brackets or tabs 100 are welded to the beam 42 for providing attachment of the utility distribution beam 42 to the uprights 31. It is noted that the brackets 100 can extend upwardly (see FIG. 9) or downwardly (see FIG. 9B) depending upon installation and appearance design requirements. The utility distribution beam 42 can rest on top of the beam structure 33 or can be separately supported, although if the utility distribution beam 42 spans between the uprights 33, it may need to be periodically supported along its length. It is contemplated that electrical wiring and cabling will be communicated along and output through electrical and communication utility outlets 101 mounted in a center section of the utility distribution beam 42. The outer end sections of the utility distribution beam 42 include quick-attach hose connectable outlet 102 or other gas dispensing connectors that are mounted to top wall 97. Piping and gas lines 102' (FIG. 9B) that connect to the gas dispensing connectors 102 are routed horizontally along the space between beams 33'. Elbows and T's are used to communicate the piping and gas lines vertically up through the cavity of utility distribution beam 42 to the gas dispensing connectors 102. The utility distribution beam 42 acts as a cover that aesthetically and visually closes the upwardly open space defined between structural beams 33', and further it physically separates the electrical utilities from the other (gas-type) utilities.

Cantilever brackets 35 (FIG. 10) include a horizontal top wall 104 and a sidewall 105 forming an L-shaped cross section. The cantilever brackets 35 further include an inner end wall 106 welded to the walls 104 and 105 to form a rigid orthogonal arrangement that can be supported from end wall 106. The illustrated cantilever brackets 35 come in pairs that are mirror images of each other, but it is contemplated that identical cantilever brackets 35 can be used if desired. End wall 106 includes a pair of vertically spaced holes 107 alignable with the holes 75 in the beams 33'. Bolts extend through the holes 75 and 107 and nuts are threaded onto the bolts to secure the cantilever brackets 35 to the beams 33'. It is contemplated that the bolts could be permanently incorporated into the brackets 35 if desired, or the nuts could be permanently tack welded to the uprights 31. Notably, the illustrated cantilever brackets 35 can be secured to locate the worksurfaces 34 at two different heights, the lower position being at a height optimally suited for use by a chair-seated person using a computer keyboarder by a wheelchair-bound person, and the higher position being at a height optimally suited for a person to work with laboratory equipment. It is contemplated that internal gussets or stiffeners can be used between walls 105–107 for increased stiffness. The illustrated arrangement will optimally support a weight of about 450 to 470 pounds on each of the worksurfaces 34. (This does not include the weight of the worksurfaces themselves, nor of weight on other components such as the shelves.) Notably, the area under worksurfaces 34 is relatively open, such that it is well suited to receive wheeled file and storage carts, and is also well suited to receive wheeled laboratory test equipment and other portable furniture or specimen-holding carriers. This facilitates a visible yet compact storage area that is highly useful, easily accessible, and aesthetically acceptable.

Figure 2:
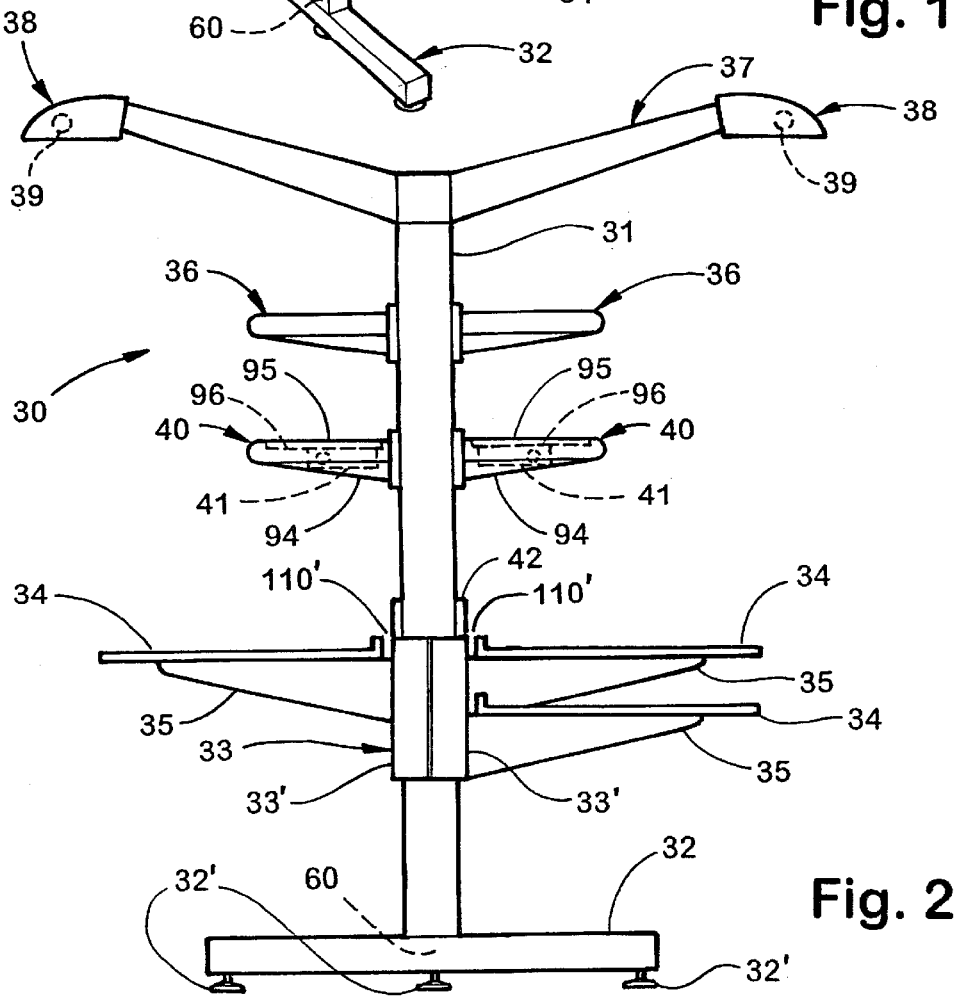
FIGS. 2–4 are end, side, and top vies of the furniture unit shown in FIG. 1.
Figure 3:
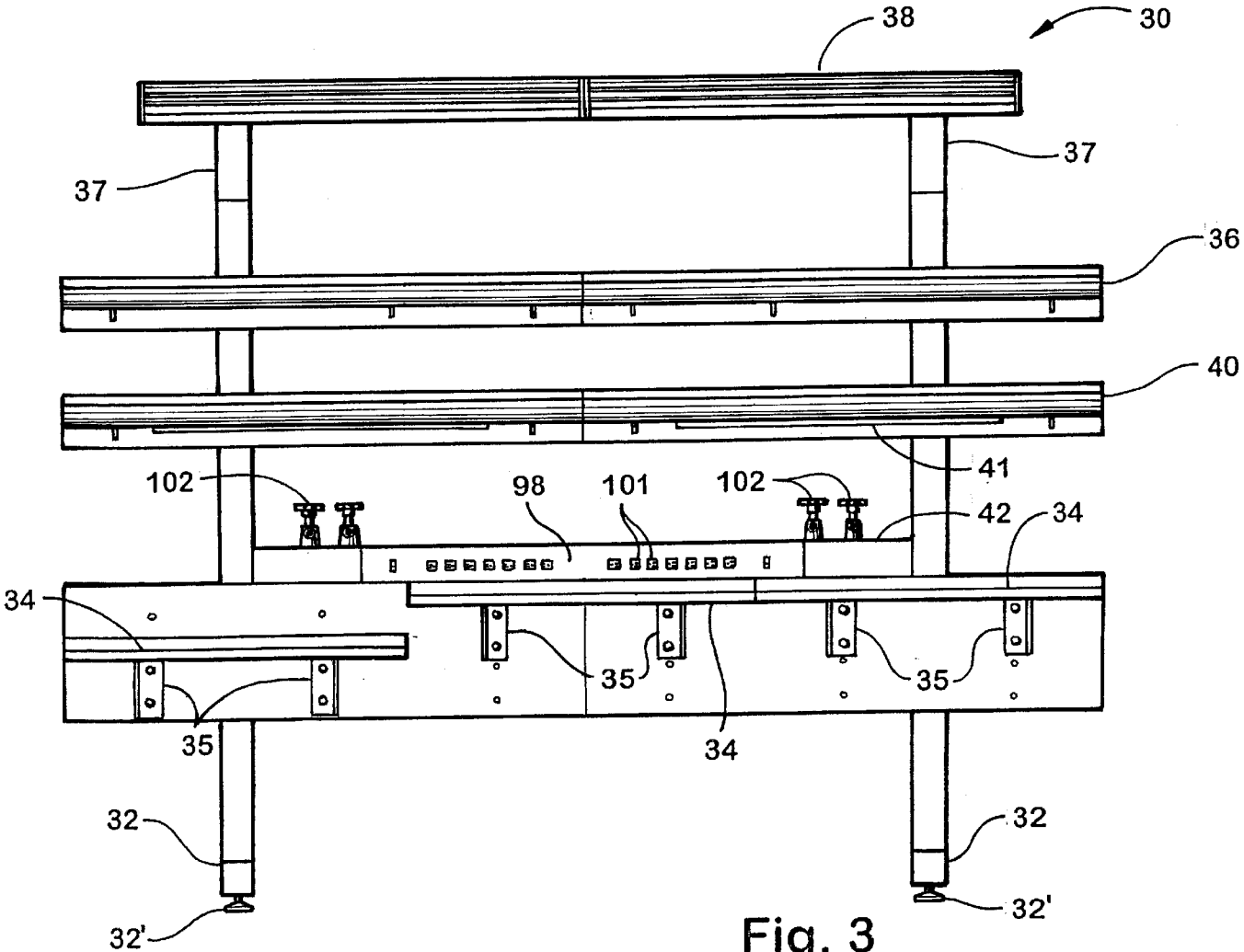
Figure 4:
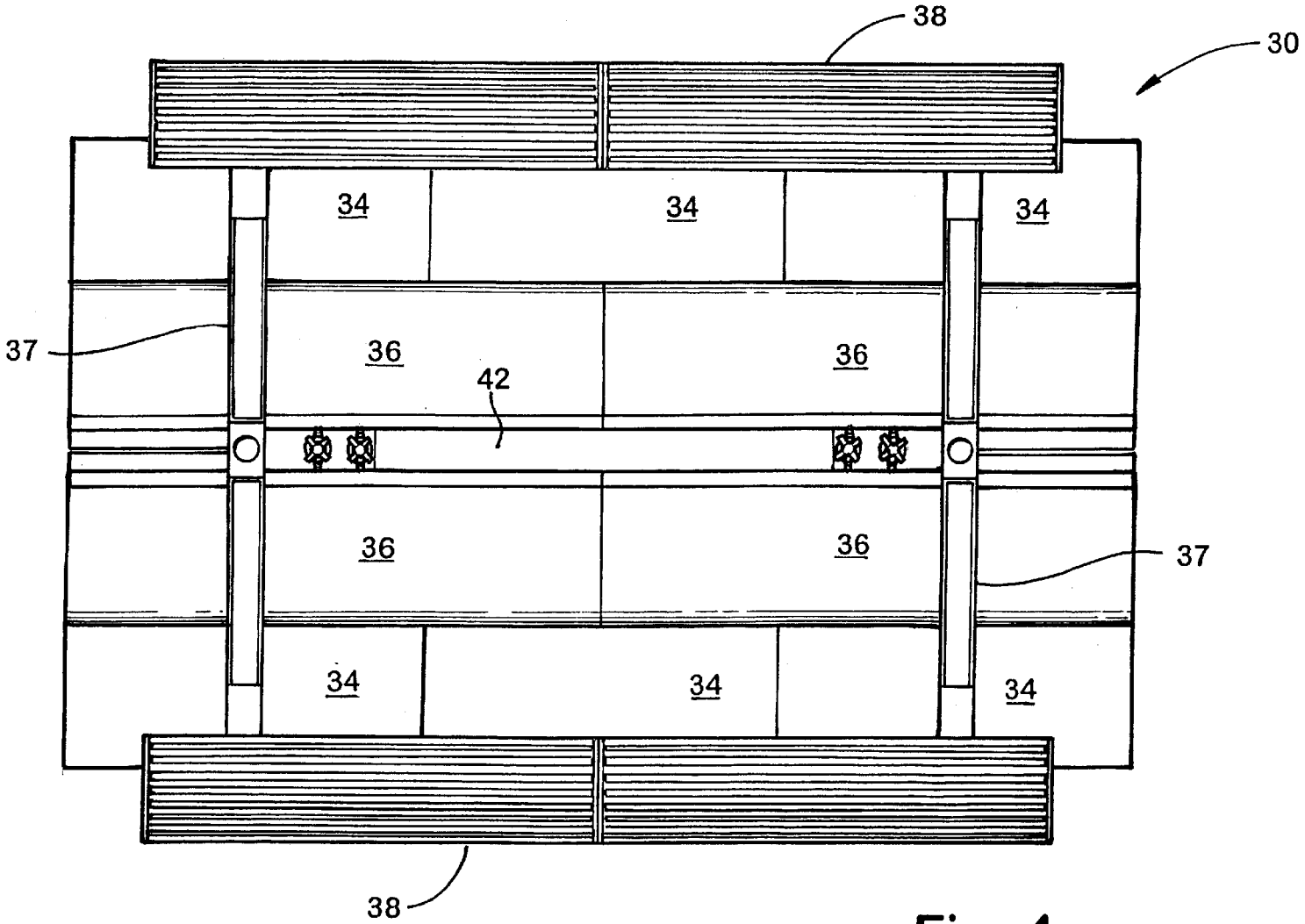
Figure 5:
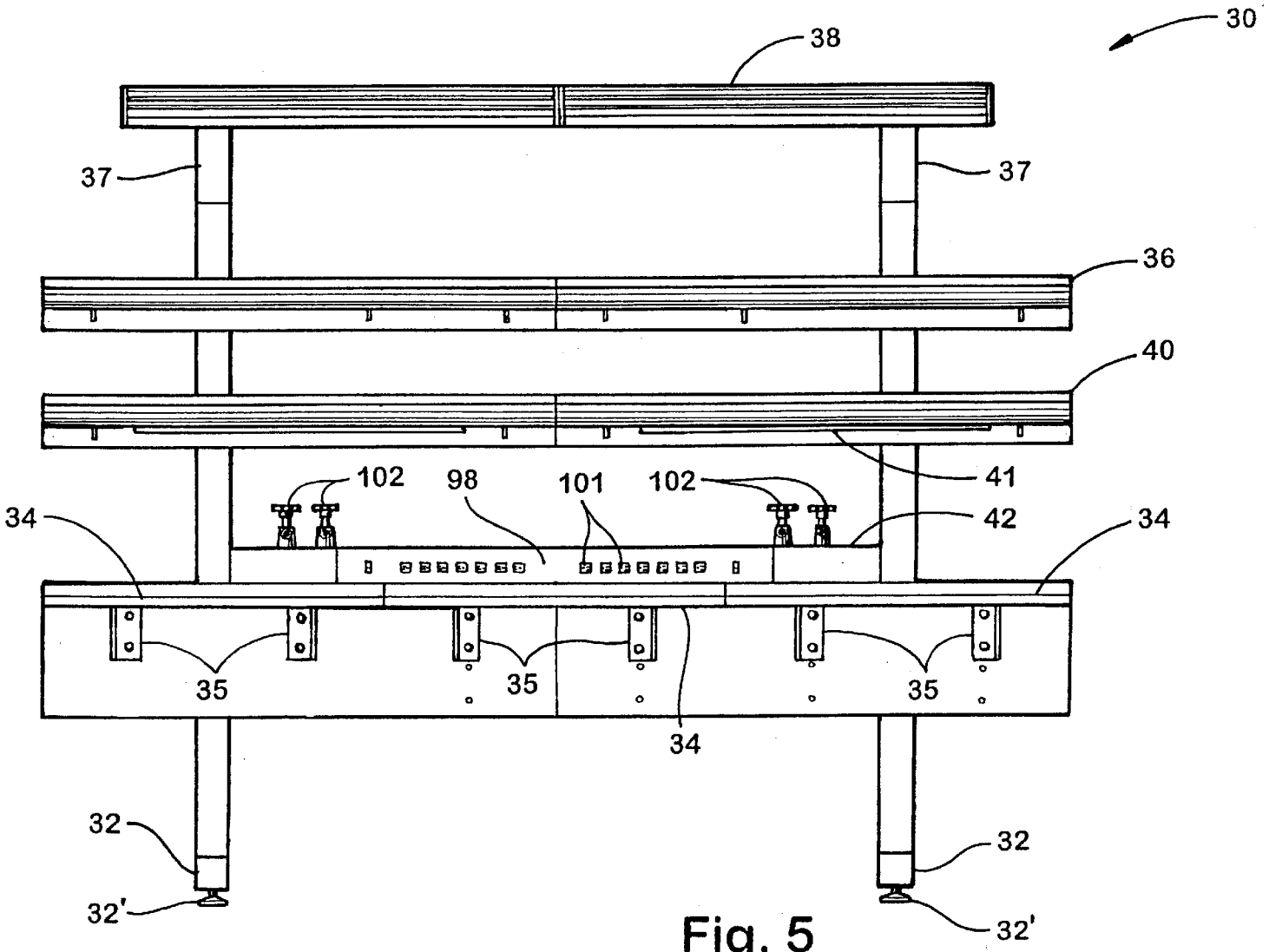
FIG. 5 is a rear side view of the furniture unit shown in FIG. 3, but with one of the worksurfaces adjusted to a lower vertical position.
Figure 11:
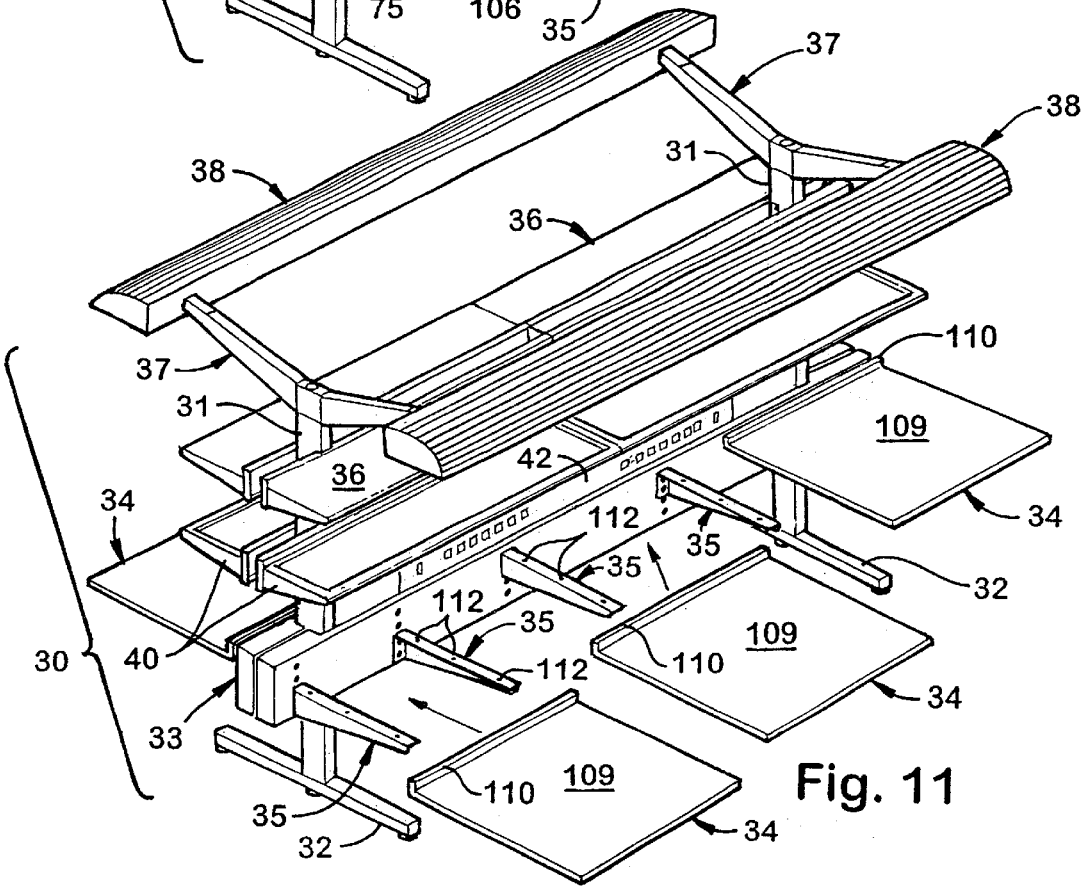
FIG. 11 is an exploded perspective view including the assembled frame, shelves, and cantilever brackets of FIG. 10, and including the worksurfaces of FIG. 1.
Figure 12:
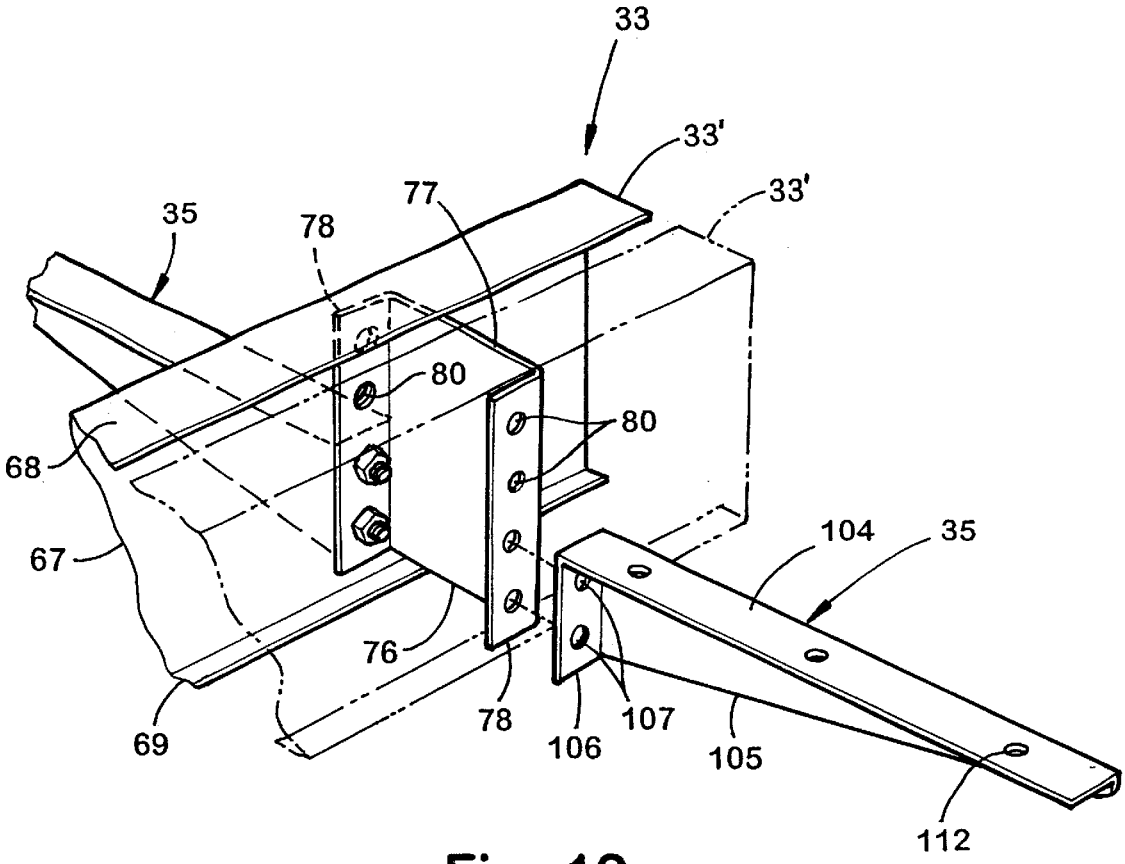
FIG. 12 is an exploded perspective view showing attachment of the cantilever brackets for supporting a worksurface to the beam shown in FIG. 11.
Figure 13:
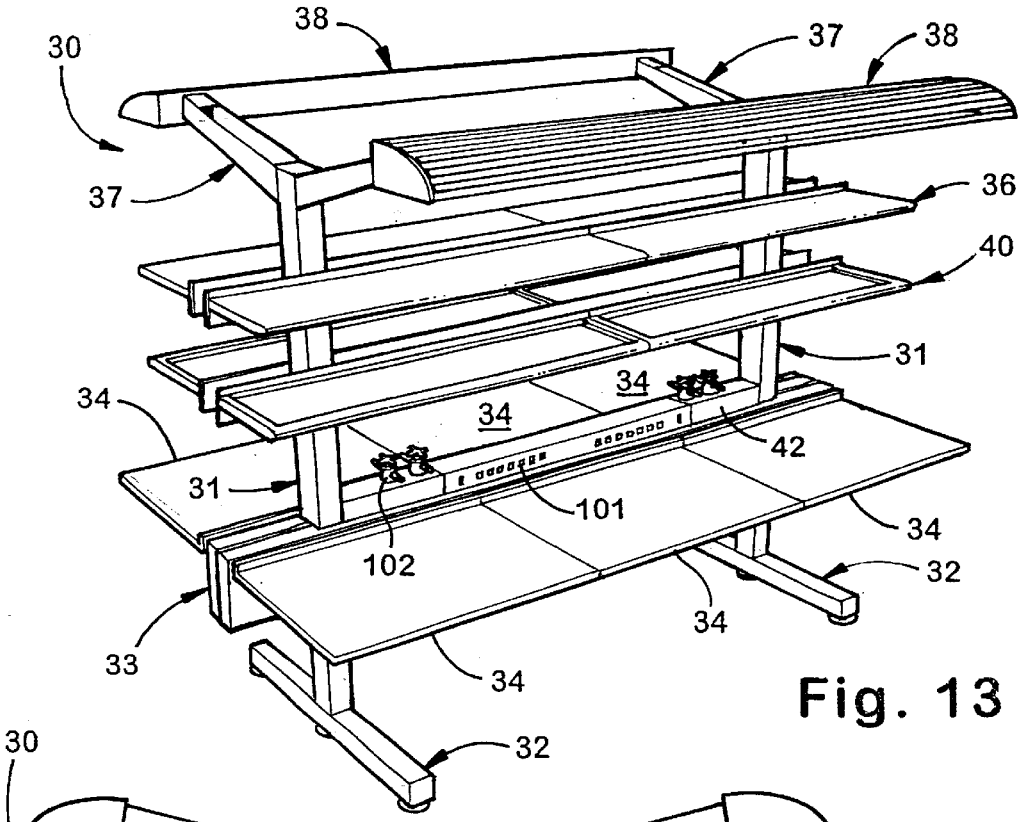
FIGS. 13 and 14 are perspective and end views similar to FIGS. 1 and 2, respectively, but with all worksurfaces adjusted to a same height.
Figure 14:
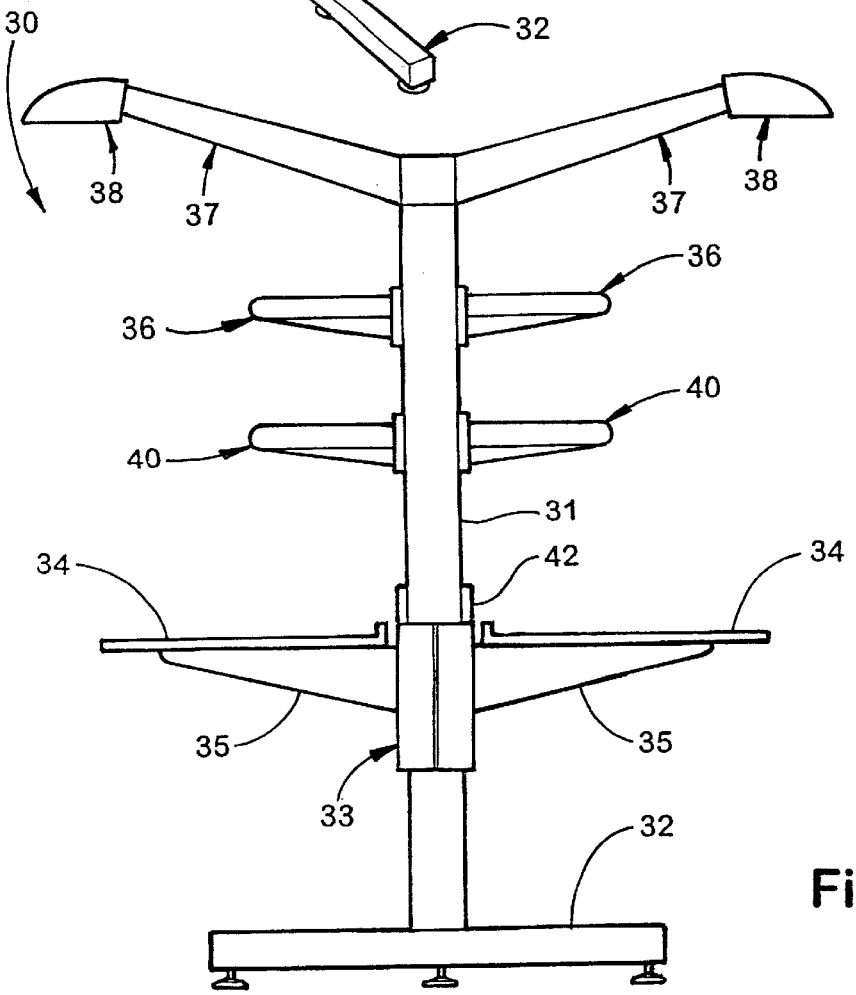

The illustrated worksurfaces 34 (FIG. 11) each has a similar size, such that they are interchangeable and each form an individual work station. The worksurfaces 34 each include a horizontal panel 109 and a rear spill-containment lip 110. The panels 109 each rest on a pair of the cantilever brackets 35 and are attached thereto by screws (not shown) that extend upwardly through holes 112 in the cantilever brackets 35 into the panels 109. When attached, the spill-containment lips 110 are spaced outwardly from the beams 33' (see FIG. 2), thus creating a slight gap 110' between the lips 110 and the beams 33' (see FIG. 2). This allows wiring to be routed into the space if desired. The illustrated worksurfaces 34 are all similar in size and are interchangeable, but it is specifically contemplated that the worksurfaces could be different sizes and shapes and can have specific features designed into them that are designed for specific laboratory work. For example, different worksurfaces 34 could have sinks, beaker-holding features, or test-equipment-holding features incorporated into them. The illustrated worksurfaces 34 that are attached to ends of the furniture unit 30 extend longitudinally along beam arrangement 33 beyond the uprights 31, thus creating an extended work area at an end of the furniture unit 30. This end area can be useful, since it provides an ergonomic area easily accessible by people on both sides of the furniture unit 30. For example, the extended work area can support a computer, a telephone, or other shared equipment.

A space is created between the rear edges of opposing shelves 40 and between inner sides of the uprights 31. This space can be left open or a divider panel 43 (FIGS. 15 and 16) can be secured in the space. The illustrated divider panel 43 is secured by attaching an up U channel 113 to a top of the utility distribution beam 33 and by attaching a down U channel 113' between the top shelves 36 (or between the bottom shelves 40). The illustrated divider panel 43 extends into the top and bottom U channels 113 and 113' across the center section of the utility distribution beam 42 and terminates short of the end sections where the hose-connectable outlets 102 are located. However, it is contemplated that the panels 43 could be extended to ends of the utility distribution beam 42. In such case, the panel 43 would include cutouts to make room for the outlets 102. It is contemplated that the panel 43 could be translucent to pass light but not images or could be any number of different structures, such as slat wall, peg board, marker board, chalkboard, see-through glass, mirrored, opaque with pass-through openings, opaque with airflow-through openings, or the like.

Lighting support 37 (FIG. 6A) includes a center tube section 115 and laterally extending upwardly angled arms 116. The center tube section 115 has a downwardly extending bottom 117 with a rectangular section shaped to telescope into close arrangement with an upper end of the upright 31. It is contemplated that the bottom 117 will extend sufficiently into the upper end of upright 31 so that no fasteners are needed for the secure support of the lamp housing structure. However, bolts or welding can be sued for increased security if desired. A top end of the center tube section 115 has an opening 118, such that wiring can be dropped from a ceiling into the upright 31 if desired. The arms 116 have a bottom wall 119, sidewalls 120, and top braces or top walls 121. The arms 116 further include end walls 122 with holes 123 configured to matingly engage ends of the lamp housing structures 38.

The lamp housing structures 38 (FIG. 10) include a curvilinear upper "shade" member 124 and a backer wall 125 connected to end panels 126. The back wall 125 is generally planar and includes holes 127 that are aligned with the holes 123 in the end walls 122 of the lighting support arms 116. It is contemplated that the lamp housing structure 38 can be rested on the end of arms 116 and bolted in place or secured in other ways. In the illustrated arrangement, a tubular pipe section or other tubular connector with a threaded outer surface is extended through the holes 127 and 124 and is secured in place with nuts. Wiring is routed through a hole in the connector and through the holes 123 and 127 from arms 116 into the lamp housing structures 38. Lamps 39 (FIG. 2) and lamp ballasts (not specifically shown) are supported in the lamp housing structures 38 under the curvature thereof. The shade member 124 of the illustrated lamp housing structures 38 (FIG. 10) are corrugated and include a plurality of closely spaced U-shaped channels each having a semi-flat center section, providing a reflective surface for reflecting light downwardly form the lamps, and with legs of the U-shaped channels providing strength for supporting the lamp housing structure 38 between the arms 116. Apertures can be formed in the shade member 124 to provide up lighting if desired.

The lighting supports 37 and the lamp housing structures 38 position the lamps 39 approximately above a front edge of the worksurfaces 34, in a location where the light produced by lamps 39 generally uniformly lights the work area. Notably, single lamps or a pair of longitudinally aligned lamps can be used in the lamp housing structures 38. This arrangement complements the undershelf light 41, which is more suited to illuminate specific tasks being done on individual worksurfaces 34.

Wiring, cabling, and electrical utilities (FIG. 9B) can be routed upwardly through the legs 32 and into the uprights 31, or can be routed vertically upwardly or downwardly directly into the uprights 31. From there, utilities are touted into the arms 116 for the overhead lighting, or into an area under the bottom shelf 40 for task lighting, or into the utility distribution beams 42 or 42'. Piped utilities, such as natural gas, CO2, or other fluid are piped horizontally into the area within beams 33', or are connected thereto by T pipe connector arrangements or hoses. It is contemplated that one upright 31 can be used for electrical power and communication utilities, while the other can be used to receive piped utilities.

A lower utility distribution beam 42' (FIG. 9B) can be secured between uprights 31 if desired under the beams 33'. The lower utility distribution beam 42' is similar in construction to the utility distribution beam 42 and need not be described in great detail for a skilled artisan to understand its construction and attachment.

An advantage of the present furniture unit 30 is its solid and heavy duty construction and its massive appearance. However, the furniture unit 30 provides an ability to ship in a compact arrangement, assemble on-site, and flexibly construct a semi-customized arrangement that optimizes usefulness for specific tasks, laboratory environments, and work groups. Also, the laboratory furniture unit 30 is sufficiently lightweight so that it can be moved and further allows adjustment of worksurfaces at individual work stations. Also, the furniture unit is modular and includes components that era readily movable and/or replaceable.

Figure 17:
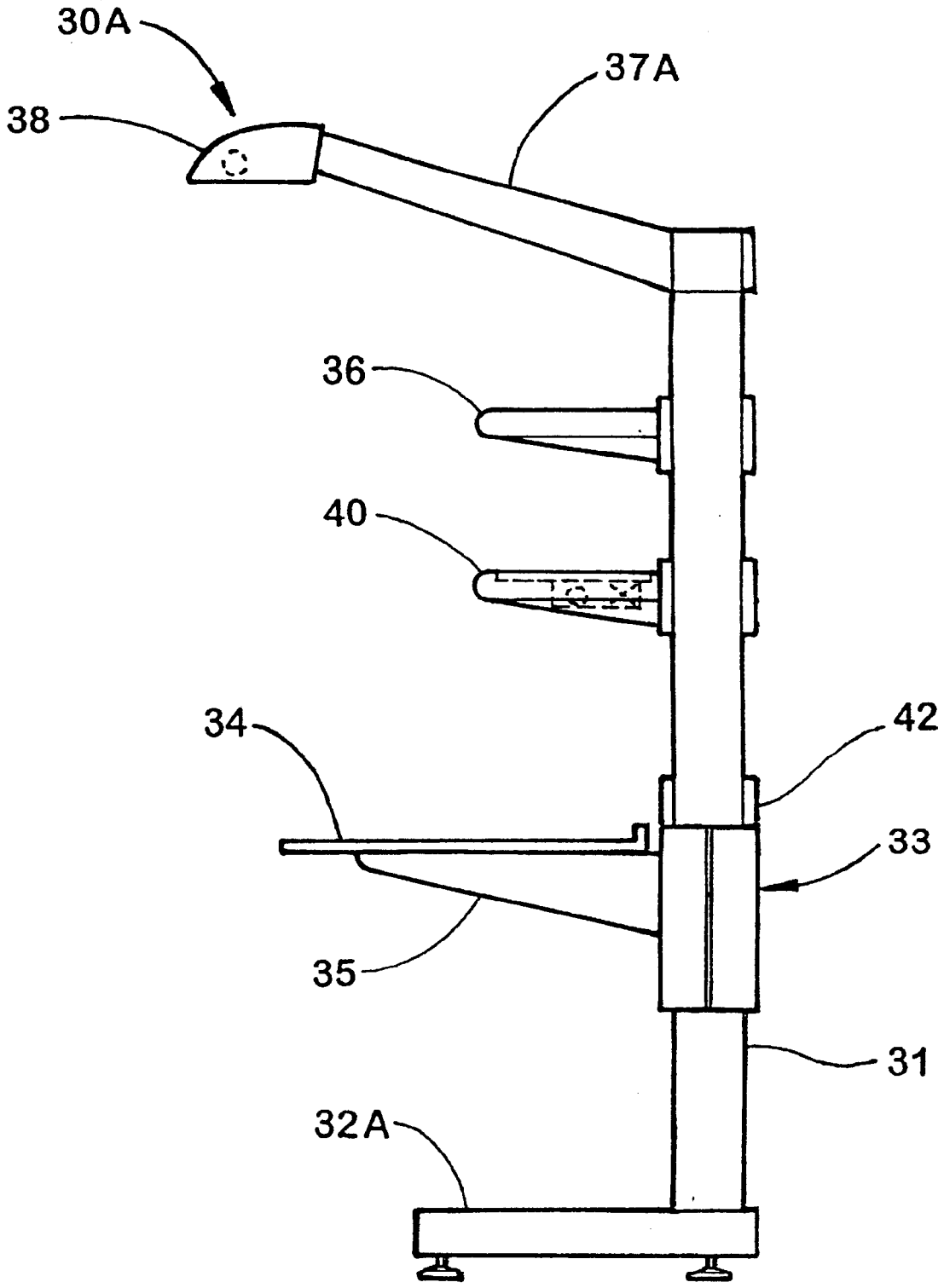
FIG. 17 is an end view of a modified "one-sided" furniture unit.

It is contemplated that the T-shaped legs 32 and the Y-shaped lighting supports 37 can be replace with L-shaped legs 32A (FIG. 17) and L-shaped lighting supports 37A to make a furniture unit 30A that is one sided, if desired. This allows the furniture unit 30A to be positioned closely against a building wall.

In the foregoing description, persons skilled in this are will recognize that modifications may be made to the invention without departing from the concepts disclosed herein. Such modifications are to be considered as included in the following claims, unless these claims by their language expressly state otherwise.

The invention claimed is:

1. A furniture unit adapted for use in a laboratory comprising:

a frame including a pair of spaced-apart uprights, a belt-high structural beam rigidly interconnecting the uprights, and legs extending from the uprights for stably supporting the frame on a floor surface, the structural beam having sides and being sufficient in structure and size to support worksurfaces and laboratory equipment in cantilever off the sides at locations spaced from the uprights;

a belt-high utility distribution beam attached between the uprights and located above the structural beam; and a plurality of worksurfaces separately adjustably supported in cantilever on the belt-high structural beam for vertical height adjustment, the worksurfaces each including cantilever brackets that engage one of the sides of the structural beam at locations spaced from the uprights, the plurality of worksurfaces including at least two front worksurfaces and at least two rear worksurfaces that extend in opposite directions.

2. The furniture unit defined in claim 1, including at least one shelf attached between the uprights that is located above the plurality of worksurfaces.

3. The furniture unit defined in claim 2, including a divider panel attached between the front and rear worksurfaces and that extends upwardly therefrom.

4. The furniture unit defined in claim 3, including a lighting support that telescopingly engages a top of the uprights.

5. The furniture unit defined in claim 4, wherein the legs include dampening levelers adapted to engage the floor surface and configured to dampen vibration transmitted to the uprights and to the worksurfaces for the floor surface.

6. The furniture unit defined in claim 5, including wiring utilities and pipe utilities extended into a space defined within the structural beam.

7. The furniture unit defined claim 6, wherein the beam structural comprises a pair of opposing C-shaped structural beams, the structural beams being about 12 gauge or a heavier gauge.

8. A furniture unit adapted for use in a laboratory comprising:

a frame including a pair of spaced-apart uprights, a belt-high structural beam rigidly interconnecting the uprights, and legs extending from the uprights for stably supporting the frame on a floor surface, the structural beam having sides an being sufficient in structure and size to support worksurfaces and laboratory equipment in cantilever off the sides at locations spaced form the uprights; and a plurality of worksurfaces separately adjustably supported in cantilever on the belt-high beam for vertical height adjustment, the plurality of worksurfaces include at least two front worksurfaces and at least two rear worksurfaces that extend in opposite directions.

9. The furniture unit defined in claim 8, wherein the worksurfaces each include cantilever brackets that engage one of the sides of the structural beam at locations spaced from the uprights.

10. The furniture unit defined in claim 9, including a belt-high distribution beam attached between the uprights and located above the structural beam.

11. The furniture unit defined in claim 8, including a belt-high utility distribution beam attached between the uprights and located above the structural beam.

12. The furniture unit defined in claim 8, including at least one shelf attached between the uprights that is located above the plurality of worksurfaces.

13. The furniture unit defined in claim 8, including a divider panel attached between the front and rear worksurfaces that extends upwardly therefrom.

14. The furniture unit defined in claim 8, including a lighting support with a down tube that telescopingly engages a top of at least one of the uprights.

15. The furniture unit defined in claim 8, wherein the legs include dampening levelers adapted to eagle the floor surface and configured to dampen vibrations transmitted to the uprights and to the worksurfaces from the floor surface.

16. The furniture unit defined in claim 8, including wiring utilities and piped utilities extended into a space defined within the structural beam.

17. The furniture unit defined in claim 8, wherein at least one of the worksurfaces extends longitudinally along the structural beam outwardly from one of the uprights to form an extended end of the furniture unit.

18. The furniture unit defined in claim 8, wherein the uprights include an upwardly open end, and utilities in the uprights, and further including a lighting support having a down tube that matingly engages at least one of the open ends, the down tube defining an internal space that communicates the utilities from the upright through the down tube to the lighting support.

19. A furniture unit adapted for use in a laboratory comprising:

a frame including a pair of spaced-apart uprights, a belt-high structural beam rigidly interconnecting the uprights, and legs extending from the uprights for stably supporting the frame on a floor surface, the structural beam having sides an being sufficient in structure and size to support worksurfaces and laboratory equipment in cantilever off the sides at locations spaced form the uprights;

a beam comprises a pair of opposing C-shaped structural beams, the structural beams being about 12 gauge or a heavier gauge; and a plurality of worksurfaces separately adjustably supported in cantilever on the belt-high beam for vertical height adjustment.

20. A furniture unit adapted for use in a laboratory comprising:

a frame including a pair of spaced-apart uprights, a belt-high structural beam rigidly interconnecting the uprights, and legs extending from the uprights for stably supporting the frame on a floor surface, the structural beam having sides and being sufficient in structure and size to support worksurfaces and laboratory equipment in cantilever off the sides at locations spaced from the uprights;

the structural beam includes opposing C-shaped beams that define an internal space for conveying utilities, and further that defines an upwardly open access slot and a downwardly open access slot; and a plurality of worksurfaces separately adjustably supported in cantilever on the belt-high beam for vertical height adjustment.

21. The furniture unit defined in claim 20, wherein the structural beam includes bracing that extends between the C-shaped beams and rigidifies the C-shaped beams.

22. A kit for constructing a furniture unit comprising:

a pair of spaced-apart uprights including legs extending from the uprights for stably supporting the furniture unit on a floor surface;

a belt-high structural beam with upright-engaging brackets constructed to rigidly interconnect the uprights in a spaced relationship;

a plurality of individual-sized worksurfaces each having cantilever brackets configured to rigidly adjustably engage a side of the belt-high structural beam and to extend laterally therefrom, such that the plurality of worksurfaces can be separately adjustably supported on the belt-high beam in laterally adjacent positions for vertical height adjustment, with at least one of the cantilever bracket engaging the belt-high structural beam at a location between the uprights;

the structural beam including opposing C shaped beams and including U-shaped reinforcements that rigidly interconnect the C shaped beams for added strength;

at least one shelf configured for attachment between the uprights at a location spaced above the plurality of worksurfaces;

a lighting support configured to engage each of the uprights; and a lamp housing structure being configured to engage and be supported on the lighting support in a location where the lamp housing structure is located generally above a front edge of one of the plurality of worksurfaces.

23. The furniture unit defined in claim 22, including bolts adjustably securing the cantilever brackets to sides of the structural beam.

24. A furniture unit comprising:

a frame including a pair of spaced-apart uprights and a belt-high structural beam rigidly interconnecting the uprights, the structural beam including opposing C shaped beams that are at least about 12 gauge beams and that engage opposing side faces of the uprights to form a box-shaped structure having sides and that is sufficient in structure and size to support worksurfaces and laboratory equipment solely in cantilever off the side faces at locations space from the uprights; and first and second worksurfaces separately supported in cantilever on the belt-high structural beam for vertical height adjustment, the first and second worksurfaces each including cantilever brackets that engage and are attached to one of the side faces.

25. A furniture unit comprising:

a frame including a pair of spaced-apart tubular uprights having upper ends;

worksurfaces supported on the frame that define work areas below the upper ends, the worksurfaces extending laterally from the frame;

first and second light supports each having a down tube shaped to mateably telescopingly engage the open ends, and further each having laterally extending opposing arms that extend over the worksurfaces; and a pair of lamp housing supported by ends of the opposing arms and extending between the first and second light supports, the lamp housings including light sources that are positioned to illuminate the work areas.

26. A furniture unit comprising:

a frame including a pair of spaced-apart tubular uprights having open bottom ends;

worksurfaces supported on the frame that define work areas above the bottom ends, the worksurfaces extending laterally; and a tubular leg connected to each of the bottom ends of the uprights at leg-to-upright connections, each leg-to-upright connection including a pair of upwardly extending spaced-apart gussets welded to the leg, the gussets being dimensioned to fit telescopingly into the associated bottom end and to closely engage opposing inside surfaces of the bottom end to achieve a stable perpendicular joint.

27. The furniture unit defined in claim 26, wherein at least one of the tubular legs includes upper and lower walls having upper and lower holes, respectively, the tubular leg defining a cavity connecting the upper and lower holes, whereby wiring from a floor source can be routed upwardly through the lower hole, through the cavity, through the upper hole, and into a passageway in the associated tubular upright.

* * * * *

UNITED STATES PATENT AND TRADEMARK OFFICE

CERTIFICATE OF CORRECTION

PATENT NO. : 6,267,064 B1
DATED : July 31, 2001
INVENTOR(S) : Hubert L. Ostertag et al.

It is certified that error appears in the above-identified patent and that said Letters Patent is hereby corrected as shown below:

Column 1,
Line 6, "traditionally" should be -- traditional --;

Column 2,
Line 34, "adjustable" should be -- adjustably --;
Line 57, "of" should be -- off --;

Column 3,
Line 29, "vies" should be -- views --;

Column 5,
Line 14, "on" should be -- to --;

Column 7,
Line 4, "outlet 102" should be -- outlets 102 --;

Column 8,
Line 33, "sued" should be -- used --;
Line 50, "124" should be -- 123 --;

Column 9,
Line 8, "touted" should be -- routed --;
Line 31, "era" should be -- are --;
Line 31, "movable" should be -- removable --;
Line 33, "replace" should be -- replaced --;
Line 38, "are" should be -- art --;

Column 10, claim 5,
Line 9, "vibration" should be -- vibrations --;
Line 10, "for" should be -- from --;

Column 10, claim 7,
Line 14, "define" should be -- defined --;

Claim 10,
Line 1, "beam structural" should be -- structural beam --;

Column 10, claim 10,
Line 37, "claim 9" should be -- claim 8 --;

UNITED STATES PATENT AND TRADEMARK OFFICE

CERTIFICATE OF CORRECTION

PATENT NO. : 6,267,064 B1
DATED : July 31, 2001
INVENTOR(S) : Hubert L. Ostertag et al.

It is certified that error appears in the above-identified patent and that said Letters Patent is hereby corrected as shown below:

Column 10, claim 15,
Line 53, "eagle" should be -- engage --;

Column 11, claim 19,
Line 9, "an" should be -- and --;

Column 11, claim 19,
Line 12, "form" should be -- from --;
Line 13, "a" should be -- the --;

Column 11, claim 22,
Line 55, "bracket" should be -- brackets --;

Column 12, claim 25,
Line 27, before "upper ends", insert -- open --.

Signed and Sealed this

Twelfth Day of March, 2002

*Attest:*

*Attesting Officer*

JAMES E. ROGAN
*Director of the United States Patent and Trademark Office*